US005951242A

United States Patent [19]

Graf

[11] Patent Number: 5,951,242

[45] Date of Patent: Sep. 14, 1999

[54] PAPER MACHINE HAVING A HIGH PRESSURE FLUID SLITTER WITH OVERFLOW COMPENSATION

[75] Inventor: Edwin X. Graf, Menasha, Wis.

[73] Assignee: Voith Sulzer Paper Technology North Amercia, Inc., Appleton, Wis.

[21] Appl. No.: 09/061,676

[22] Filed: Apr. 16, 1998

[51] Int. Cl.[6] ..... F04D 1/12

[52] U.S. Cl. ..... 415/90; 415/88; 415/89; 415/90; 83/53; 83/117

[58] Field of Search ..... 415/88, 89, 90; 83/117, 53

[56] References Cited

U.S. PATENT DOCUMENTS

| | | | |
|---|---|---|---|
| 1,997,061 | 4/1935 | Hollander | 415/90 |
| 3,004,495 | 10/1961 | Macklis | 415/89 |
| 3,093,080 | 6/1963 | Tarifa et al. | 415/24 |
| 3,123,861 | 3/1964 | Westover | 425/377 |
| 3,180,268 | 4/1965 | Willis et al. | 417/406 |
| 4,239,448 | 12/1980 | Graf | 415/89 |

*Primary Examiner*—Edward K. Look
*Assistant Examiner*—Rhonda Barton
*Attorney, Agent, or Firm*—Taylor & Associates, P.C.

[57] ABSTRACT

A paper machine has a high pressure liquid pump for use with a liquid slitter for slitting a fiber material web. The high pressure liquid pump includes a pump shell having an axis of rotation and an annular smooth inwardly facing surface. The inwardly facing surface is configured for carrying a film of liquid thereon. A hydraulic shoe having an outer convexly curved working face is in close running engagement with the inwardly facing surface. A pivotal arm is connected with the shoe and positions the shoe relative to the inwardly facing surface. The arm is movable toward and away from the inwardly facing surface. A hydraulic pressure member is engaged with the arm for urging the shoe toward the inwardly facing surface dependent upon a hydraulic pressure therein. The pump shell is driven about the axis of rotation, thereby continuously moving the inwardly facing surface of the pump shell past the shoe and continuously forming a hydraulic wedge of high-pressure liquid between the inwardly facing surface and the working face.

7 Claims, 3 Drawing Sheets

PAPER MACHINE HAVING A HIGH PRESSURE FLUID SLITTER WITH OVERFLOW COMPENSATION

BACKGROUND OF THE INVENTION

1. Field of the Invention.

The present invention relates to high-pressure, low-delivery liquid pumps used in paper machines for waterjet cutting or slitting a continuous traveling fiber material web, such as a paper web.

2. Description of the Related Art.

Waterjet cutters or slitters are used in a paper machine to cut a traveling fiber material web. A moving high-pressure stream of liquid which is used for cutting affords advantages in that the liquid can be ordinary water without additives. The cutting operation is dust-free and does not create dust problems which result in creating wear in machinery, pollution of the air and health hazards. Waterjet cutting is advantageous in that it does not require space-consuming and complex cutting equipment, and the mechanism can be easily operated and controlled for a variety of cutting conditions with variations in speed and thickness of material and other variations which must be encountered in commercial cutting operations.

However, to provide a continuous supply of water in very small quantities at very high pressures such as used in paper web cutting, the reliable operating life of most conventional pumps is severely limited. Pressures in the range of 10,000 psi to 60,000 psi must be available at very small delivery quantities of water and such pumps frequently have an operating life on the order of only 250 hours without requiring shutdown and attention. Further, such pumps require parts with critical tolerances and the moving parts must be carefully and precisely machined. Also, conventional pumps are generally mechanically complex and many are unreliable in applications where the fluid is water and cannot contain rust inhibitors.

U.S. Pat. No. 4,239,448 (Graf), now expired, describes a high-pressure, low delivery liquid pump for use in a paper machine which is simple, effective and reliable. A hydraulic wedge is created between a hydraulic shoe and a rotating inwardly facing surface of a pump shell. A fluid passage having an inlet at the working surface of the shoe transports high-pressure liquid away from the hydraulic wedge to a cutting head of a slitter.

The high-pressure, low delivery liquid pump described by Graf '448 requires a control system to ensure that the liquid within the pump adjacent to the pump shell is kept at a relatively small predetermined level. The fluid passage only draws away a relatively small amount of water under high pressure from the hydraulic wedge. If too much water is introduced into the pump, the hydraulic shoe must "push" the excess water ahead of the shoe as the pump shell rotates. The excess water is not actually immediately used since it is not in the high-pressure region of the hydraulic wedge, and substantially adds to the power requirements to drive the rotation of the pump shell. The necessary increased power in turn decreases the efficiency of the pump and increases the cost to operate the pump. It is therefore necessary to provide a relatively complicated and expensive control system to control the water flow into and operation of the pump.

What is needed in the art is a high-pressure, low delivery liquid pump for use in a paper machine which maintains necessary input power at a minimum by removing excess or overflow water from the pump without the need for a complex and expensive control system.

SUMMARY OF THE INVENTION

The present invention provides an overflow passage in each shoe which is at the leading edge of the shoe and outside the high-pressure hydraulic wedge area of the shoe. Each overflow passage transports the overflow or excess water away from the respective shoe and out of the pump.

The invention comprises, in one form thereof, a paper machine having a high pressure liquid pump for use with a liquid slitter for slitting a fiber material web. The high pressure liquid pump includes a pump shell having an axis of rotation and an annular smooth inwardly facing surface. The inwardly facing surface is configured for carrying a film of liquid thereon. A hydraulic shoe having an outer convexly curved working face is in close running engagement with the inwardly facing surface. A pivotal arm is connected with the shoe and positions the shoe relative to the inwardly facing surface. The arm is movable toward and away from the inwardly facing surface. A hydraulic pressure member is engaged with the arm for urging the shoe toward the inwardly facing surface dependent upon a hydraulic pressure therein. The pump shell is driven about the axis of rotation, thereby continuously moving the inwardly facing surface of the pump shell past the shoe and continuously forming a hydraulic wedge of high-pressure liquid between the inwardly facing surface and the working face. A high pressure passage through the shoe has an inlet positioned in the working face and is configured for transporting the high pressure liquid in the hydraulic wedge away from the shoe. An overflow passage through the shoe has an inlet positioned at a leading edge of the shoe relative to the direction of rotation of the pump shell and substantially outside the working face. The overflow passage is configured for transporting excess liquid outside of the hydraulic wedge away from the shoe.

An advantage of the present invention is that excess or overflow liquid is transported out of the pump so that required input power is maintained at a minimum.

Another advantage of the present invention is that the pump provides for delivery of cutting fluid such as water in low volumes at very high pressures and is capable of doing so over long operating periods without repair.

Yet another advantage is that the pump requires a minimum of moving parts and a minimum of machined parts with the parts not requiring critical tolerances for pumping liquid in very small volumes at very high pressures.

A still further advantage is that the output pressure of the pump can be easily controlled during operation, and the number of contacting parts are reduced to a minimum to reduce operating wear.

A further advantage is that the pump is capable of an almost indefinite operating life because of the absence of contacting wearing parts.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
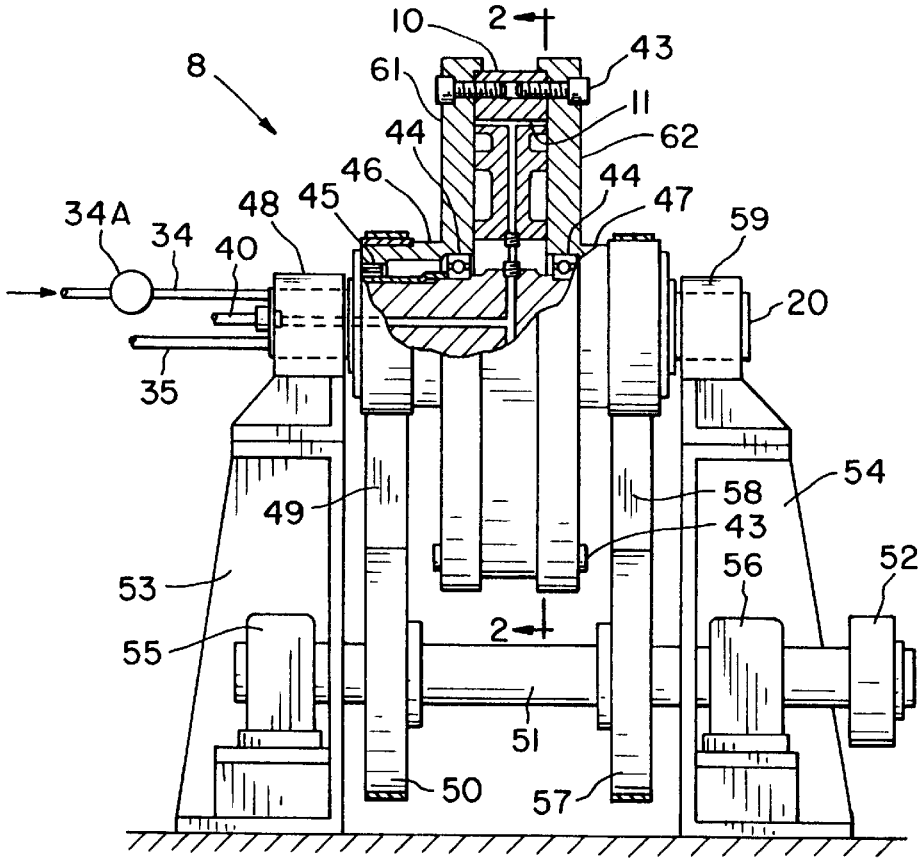
FIG. 1 is a fragmentary, elevational view of an embodiment of a high-pressure, low-delivery pump of the present invention.
Figure 2:
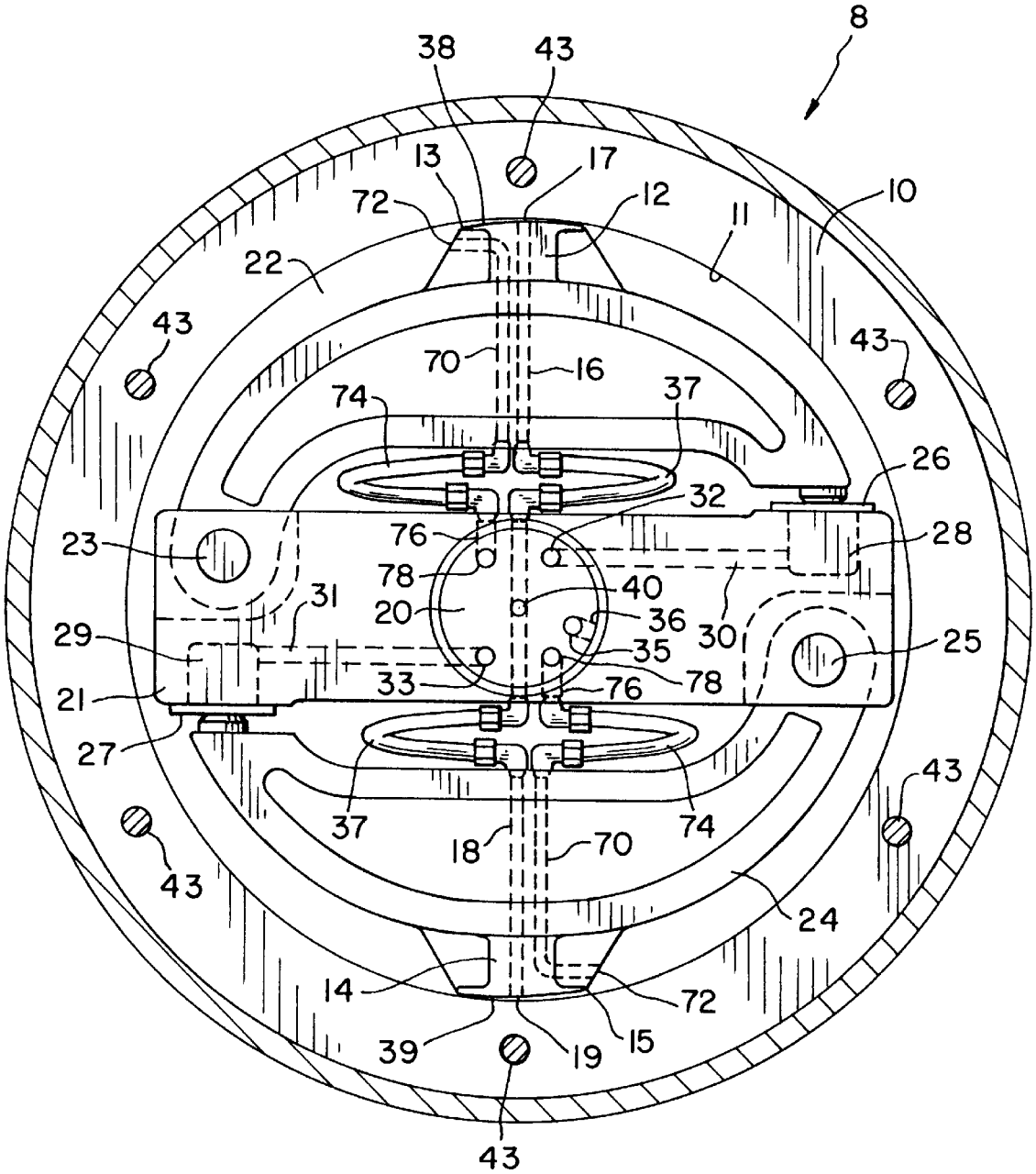
FIG. 2 is a sectional view taken along line 2—2 of FIG. 1.
Figure 4:
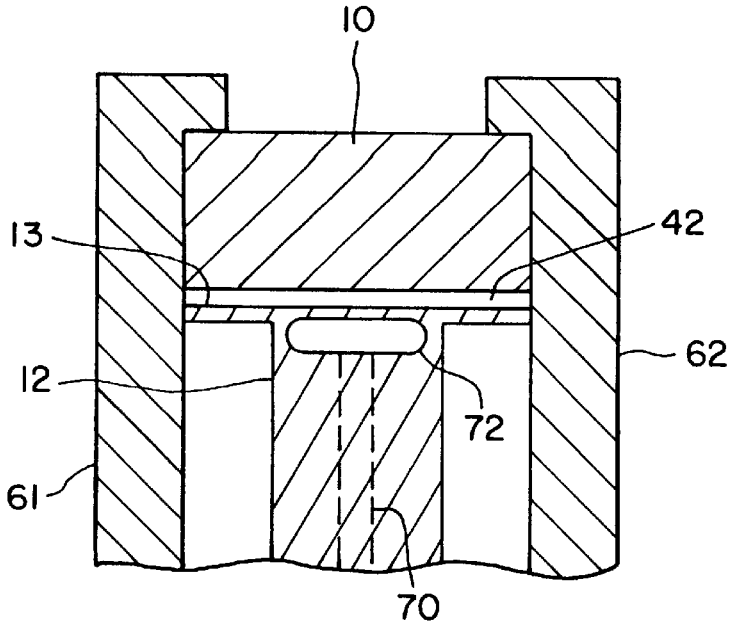
FIG. 4 is a fragmentary sectional view taken along line 4—4 in FIG. 3.

Referring now to the drawings, and more particularly to FIGS. 1 and 2, there is shown an embodiment of a pump 8 which includes an annular pump shell 10 having a smooth inwardly facing surface 11. A hydraulic shoe 12 having a relieved leading edge 13 coacts with smooth inwardly facing surface 11 by being in close running engagement with inwardly facing surface 11 sufficiently close to create a hydraulic wedge of fluid between shoe 12 and the relatively moving inwardly facing surface 11. A similar shoe 14, also having a relieved leading edge 15, is located at a position diametrically opposite shoe 12. Shoes 12 and 14 in these locations balance the forces on pump shell 10 relative to the central axis of pump shell 10. It will be understood, of course, that pump 8 will operate with a single shoe or with additional numbers of shoes.

The low-volume, high-pressure liquid delivery of pump 8 is obtained through a passage 16 for shoe 12, and a passage 18 for shoe 14. Shoe 12 has an inlet 17 leading into passage 16 and shoe 14 has an inlet 19 leading into passage 18 through which the liquid flows from the hydraulic wedge. As illustrated in the detailed view of FIG. 3, inwardly facing surface 11 carries a thin layer of liquid such as water 41 which remains there due to rimming by centrifugal force.

Shoes 12 and 14 are mounted on a central stationary shaft 20. While advantages are attained in driving pump shell 10 in rotation about shoes 12 and 14, it is possible to rotate pump 8 rotatably by driving shoes 12 and 14 relative to pump shell 8.

Shoes 12 and 14 are supported on pivotal arms 22 and 24, which are respectively pivoted at pins 23 and 25 on a block 21 supported on shaft 20. Arms 22 and 24 are pushed outwardly to control the force at which shoes 12 and 14 are urged against inwardly facing surface 11 and hence the output delivery pressure of pump 8. For this purpose, hydraulic plungers 26 and 27 push against the moveable ends of arms 22 and 24. Plungers 26 and 27 are operated by hydraulic fluid in cylinders 28 and 29 therebeneath. Hydraulic fluid at controlled pressure is delivered to cylinders 28 and 29 through radial passages 30 and 31 from axial passages 32 and 33 leading through shaft 20 from a hydraulic pressure supply line 34 which has a pressure control valve 34A which can be adjusted to control the output pressure of pump 8.

To supply water to pump 8, axial supply passage 35 leads through stationary shaft 20 and radially out through an opening 36. Sufficient water is provided to maintain shallow film 41 against inwardly facing surface 11 which creates hydraulic wedge 42. In addition to controlling pressure by regulating the hydraulic force used to pivot arms 22 and 24 and urge shoes 12 and 14 outwardly, the speed of rotation of pump 8 also changes the output pressure. That is, increased speed increases the hydraulic pressure in hydraulic wedge 42 to increase the delivered pressure out through passage 16. Also, at start-up, the force on arms 22 and 24 is relieved so that no actual metal-to-metal contact occurs between shoes 12 and 14 and the inwardly facing surface 11 of pump shell 10 to avoid scoring of pump shell 10 and working faces 38 and 39 of shoes 12 and 14, respectively. While a relatively narrow shell and shoe are employed, as illustrated generally in FIG. 1, if a pump of increased capacity is desired, the axial width of the shoe and shell can be increased and a plurality of inlets 17 and 19 can be provided instead of single inlet 17 and 19 along working faces 38 and 39 of shoes 12 and 14. Shoe 12 can generally be made in the shape illustrated or can be made with a convex shape with a radius of curvature smaller than inwardly facing surface 11. Shoe 12 can also be pivotally supported on arm 22 so that it will assume a natural position relative to the hydraulic forces built up between shoe 12 and pump shell 10.

As shown in FIG. 1, pump shell 10 is constructed in the form of an annular ring and disk-shaped side plates 61 and 62 are bolted together by axially extending through bolts 43. Plates 61 and 62 have respective hubs 46 and 47 and within hubs 46 and 47 are supporting annular bearings, such as bearings 44 and 45 for hub 46. Hub 47 is provided with similar bearings, not shown, for rotatably supporting the shell and its carrying assembly on stationary shaft 20. Pump shell 10 is driven by ring gears 48 and 59. Pump 8 is supported on side pedestals 53 and 54. Mounted at the base of pedestals 53 and 54 is a drive shaft 51 which is supported on bearings 55 and 56. Drive shaft 51 carries gears 50 and 57 which through intermediate gear belts 49 and 58 drive ring gears 48 and 59. It will, of course, be understood that while dual drive trains are illustrated, a single drive gearing system may be employed. Drive shaft 51 is driven by an input gear or sheave 52 which is driven by a suitable motor (not shown). Variable speed control may be provided if desired by varying the drive speed at the motor or in the drive train.

Figure 3:
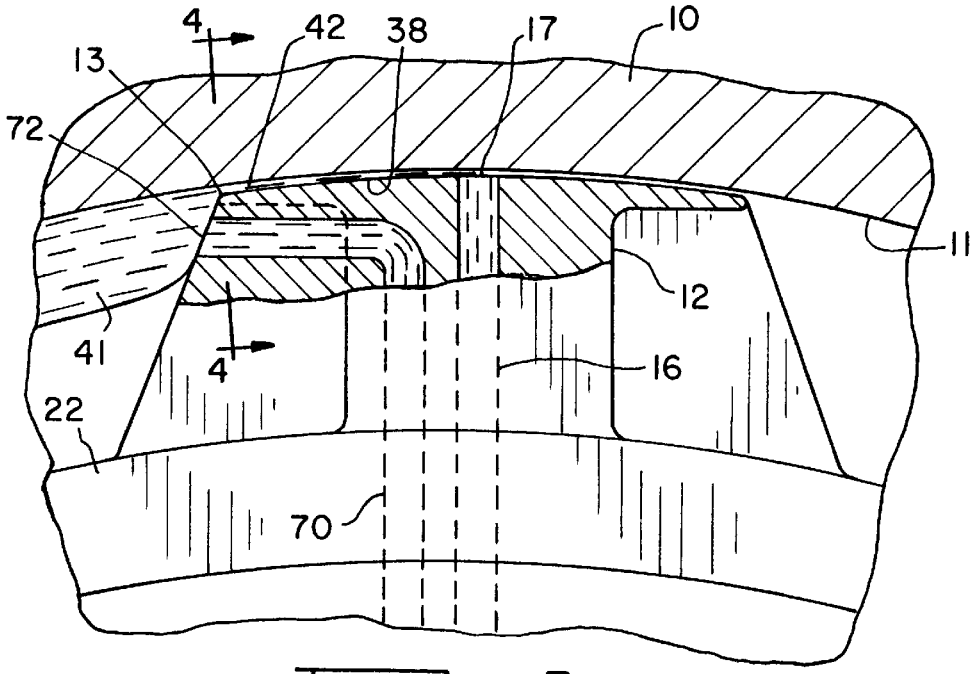
FIG. 3 is an enlarged, fragmentary sectional view of a hydraulic shoe and smooth pump shell shown in FIGS. 1 and 2.

According to the present invention, shoes 12 and 14 each include at least one overflow passage 70 which is configured for transporting overflow or excess liquid outside of the area of hydraulic wedge 42 away from respective shoes 12 and 14. Overflow passage 70 has an inlet 72 which is positioned adjacent to a leading edge 13 or 15 of a respective shoe 12 and 14, relative to the direction of rotation of pump shell 10. Each inlet 72 is positioned outside of the area of the working face of shoes 12 and 14, so as not to draw high pressure liquid away from hydraulic wedge 42 or between working face 38 or 39 and inwardly facing surface 11 of pump shell 10. Each overflow passage 70 in shoes 12 and 14 is connected via a flexible coupling, such as a flexible hose 74, to a respective radial passage 76 and axial passage 78. Flexible hoses 74 allow relative rotational movement while still maintaining fluid interconnection between arms 22 and 24 and block 21. As shown in FIG. 3, it is possible for an excess amount of water to build up ahead of shoes 12 and 14, e.g., at the start-up of pump 8 or if the supply of water into pump 8 is not precisely controlled. Overflow passages 70 transport the excess water way from shoes 12 and 14 and out of pump 8. Overflow passages 70 therefore prevent "water logging" of pump 8 and maintain the power input requirements necessary to rotatably drive pump shell 10 at a minimum.

Figure 5:
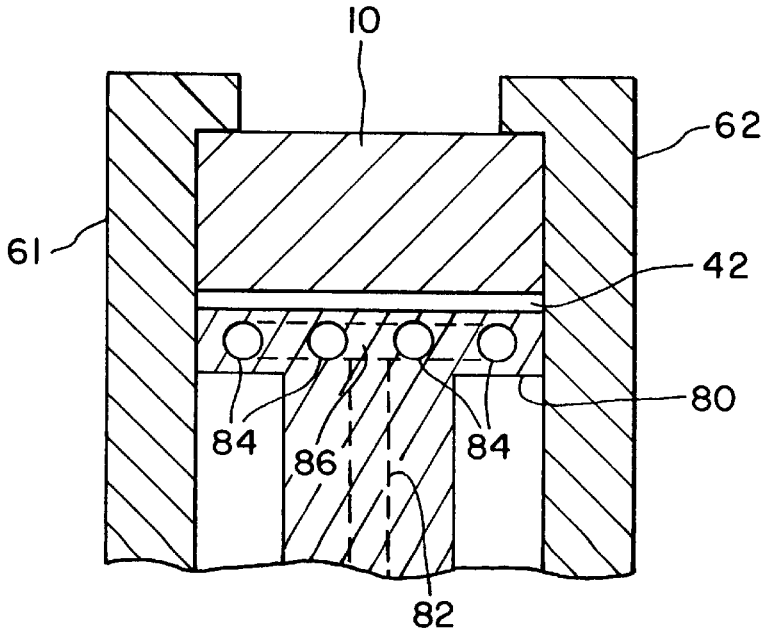
FIG. 5 is a fragmentary sectional view of another embodiment of a hydraulic shoe in a pump of the present invention.

In the embodiment of pump 8 shown in FIGS. 1-4, inlet 72 of each overflow passage 70 has a substantially oval cross-sectional shape which is intended to provide a larger surface area for drawing excess water into overflow passage 70. However, it will be appreciated that the particular cross-sectional shape and/or size of inlet 72 may vary, and/or the number of inlets and/or overflow passages 70 associated with each shoe 12 or 14 may vary. For example, referring to FIG. 5, there is shown another embodiment of a hydraulic shoe 80 including an overflow passage 82 having four inlets 84 connected therewith via a common axial passage 86.

In operation, water is placed in a limited amount within pump shell 10, and pump 8 is brought up to an operating speed without applying radial outward force on arms 22 and 24 carrying shoes 12 and 14. When an operating speed is reached, shoes 12 and 14 are forced outwardly by hydraulic plungers 26 and 27 and a hydraulic wedge 42 is built up at leading edge 13 and 15 of each of shoes 12 and 14. The water is relatively incompressible so that at the high pressure developed, it flows out through inlet 17 in shoe 12 through passage 16 which connects through a connecting line 37 to a passage 39 and delivery line 40 leading through shaft 20. Line 37 is flexible, and the other shoe 14 is provided with a similar flexible line 37 connecting between passage 18 to a passage 38 and delivery line 40 leading through shaft 20. If an overflow or excess amount of water is built up ahead of shoes 12 and/or 14, the excess water is transported into overflow passages 70 through inlets 72 positioned at the leading edge of each shoe 12 and 14 outside the area of hydraulic wedge 42. A variation in hydraulic output pressure can be accomplished by changing the speed of rotation of pump shell 10, and/or by changing the force applied to pivot arms 22 and 24 outwardly and hence the force with which shoes 12 and 14 are pressed outwardly toward inwardly facing surface 11 of pump shell 10. Thus, there is provided a high-speed pump 8 where there are no rubbing parts and the only substantially moving parts are pump shell 10 which is supported on dual bearings at each side. Pressures such as needed for high-speed and high-pressure water cutting are attained through a pump which has an operating life that far exceeds most conventional pumps.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, a high pressure liquid pump for use with a liquid slitter for slitting a fiber material web, said high pressure liquid pump comprising:

a pump shell having an axis of rotation and an annular smooth inwardly facing surface, said inwardly facing surface configured for carrying a film of liquid thereon;

a hydraulic shoe having an outer convexly curved working face for coacting close running engagement with said inwardly facing surface;

a pivotal arm connected with said shoe and positioning said shoe relative to said inwardly facing surface, said arm being movable toward and away from said inwardly facing surface;

a hydraulic pressure member engaged with said arm for urging said shoe toward said inwardly facing surface dependent upon a hydraulic pressure therein;

means for rotatably driving said pump shell about said axis of rotation, thereby continuously moving said inwardly facing surface of said pump shell past said shoe and continuously forming a hydraulic wedge of high-pressure liquid between said inwardly facing surface and said working face;

a high pressure passage through said shoe, said high pressure passage having an inlet positioned in said working face and being configured for transporting the high pressure liquid in said hydraulic wedge away from said shoe; and an overflow passage through said shoe, said overflow passage having an inlet positioned at a leading edge of said shoe relative to said direction of rotation of said pump shell and substantially outside said working face, said overflow passage being configured for transporting excess liquid outside of said hydraulic wedge away from said shoe.

2. The paper machine of claim 1, wherein said overflow passage is positioned entirely outside said working face.

3. The paper machine of claim 1, wherein said overflow passage comprises one overflow passage.

4. The paper machine of claim 1, wherein said overflow passage comprises a plurality of overflow sub-passages.

5. The paper machine of claim 1, wherein said overflow passage has a substantially circular cross section.

6. The paper machine of claim 1, wherein said overflow passage has a substantially rectangular cross section.

7. The paper machine of claim 1, wherein said arm has a second overflow passage connected with said overflow passage in said shoe, and further comprising a stationary block pivotally connected to said arm and having a third overflow passage, and a flexible coupling interconnecting said second overflow passage of said arm with said third overflow passage of said block.

* * * * *